US006357235B1

(12) United States Patent
Cerro

(10) Patent No.: US 6,357,235 B1
(45) Date of Patent: Mar. 19, 2002

(54) POWER GENERATION SYSTEM AND METHOD

(75) Inventor: Horacio Antonio Ramos Cerro, Sucre (CO)

(73) Assignee: Cacumen LTDA., Cartagena (BO)

( * ) Notice: Subject to any disclaimer, the term of this patent is extended or adjusted under 35 U.S.C. 154(b) by 0 days.

(21) Appl. No.: 09/516,847

(22) Filed: Mar. 2, 2000

(51) Int. Cl.[7] ..... F01K 13/00
(52) U.S. Cl. ..... 60/645; 60/670
(58) Field of Search ..... 60/643, 645, 670; 417/404

(56) References Cited

U.S. PATENT DOCUMENTS 4,214,450 A * 7/1980 Nagashima et al. ..... 60/670 X
4,224,013 A * 9/1980 Davis, Sr. ..... 417/404
4,479,354 A * 10/1984 Cosby ..... 60/645 X
4,811,558 A * 3/1989 Baugh ..... 417/404 X
5,110,267 A * 5/1992 Giordani ..... 417/404
5,137,681 A 8/1992 Dougherty
5,302,090 A * 4/1994 Schoo ..... 417/404 X

* cited by examiner

*Primary Examiner*—Hoang Nguyen
(74) *Attorney, Agent, or Firm*—Streets & Steele; Jeffrey L. Streets

(57) ABSTRACT

The present invention provides a system for managing large fluid flows at high pressures. This system consists of an elemental chamber the operation of which is based on energy transmission by "impact" resulting from the instantaneous discharge of a "motor fluid" at a given pressure to generate a "linear" movement that raises pressure and propels fluid. This system provides an increase in working fluid pressure more efficiently that any presently available system, thanks to the linear transmission of energy, making it highly efficient. The combined arrangement of these chambers allows the managing of high fluid flows at high pressures. This system permits power to be produced through a steam cycle without the need for a phase change, eliminating all condensation and pre-heating stage devices that are replaced by more efficient equipment not requiring the phase change. Thus there is a considerable decrease in the use of fuel, environmental pollution, toxic fumes and thermal pollution, obtaining energy at lower costs.

23 Claims, 5 Drawing Sheets

POWER GENERATION SYSTEM AND METHOD

BACKGROUND OF THE INVENTION

1. Field of the Invention

This invention relates generally to power generation cycles, and more specifically to a steam power plant that utilizes a compressor.

2. Description of the Related Art

The first pneumatic transmission dates back to the year 1700, when the French Physicist Denis Papin used the force of a windmill to compress fluid that was then transported through pipes. Approximately one century later, British inventor George Medhurst obtained a patent on a device to propel an engine with compressed fluid, although the first practical implementation of this method is usually attributed to inventor George Law who, in 1865, designed a rock drill in which an air-driven piston activated a hammer. The use of this drill became widely accepted and was used in the perforation of the Mount Cenis tunnel in The Alps, inaugurated in 1871, and in the Hossac in Massachusetts (United States of America), inaugurated in 1875. Another significant breakthrough was the compressed air train break, designed around 1868 by the American inventor, engineer, and industrialist George Westinghouse.

Fluid pumping arose from the need to transport fluid through pipes or channels. This fluid movement is accomplished through energy transfer. The usual means to accomplish fluid flow are: gravity, displacement, centrifugal force, electromagnetic power, movement quantity transfer, mechanical impulse, or a combination of these six basic principles. After gravity, the most common means used at present is centrifugal force.

Discharge of a fluid from a vessel by the total or partial displacement of the vessel's internal volume by a second flow, or through mechanical means, is the principle of operation of many fluid transport systems. This group includes the diaphragm and alternating piston-movement machines, gear and rotating blade-type devices, fluid piston compressors, oval tanks for acid fluid storage, and pneumatic elevators.

When centrifuge force is used, this force is supplied through a pump or a compressor. Although the physical characteristics of the different types of compressors and centrifugal pumps differ widely, their basic function is always the same, that is, the production of kinetic energy through the action of a centrifugal force, and then the partial conversion of this energy into pressure through efficient fluid velocity reduction.

When the fluid involved is a good electrical conductor, as in the case of melted metals, an electromagnetic field can be applied around the fluid conduit, so as to generate a propelling force that will cause the flow to take place.

The deceleration of a fluid to transfer its momentum, or amount of movement, to another fluid is a commonly used principle for corrosive material management, for pumping from inaccessible depths, or for casting.

The mechanical force principle, applied to fluids, is usually combined with another means of creating movement.

a. Compressors

Gaseous fluid pressure is raised by devices called compressors. There are commonly two types of compressors: alternating and centrifugal. Alternating compressors can be divided into the rotating and reciprocating types. These compressors have constant capacity and variable discharge pressures.

Positive displacement rotating compressors use an additional mobile, rotating part activated by a shaft or axle of an engine that can be of different types. Contrary to centrifugal compressors (described below), their flow is not smooth nor pulsation free. There are several types of positive displacement rotating compressors, among them the pipe blower, the rotating spiral, and the water ring types. All have substantially the same performance curve of the reciprocating compressor; that is to say, they have fixed capacity and variable counter-pressure. Rotating compressors are more useful than reciprocating ones for variable speed motor units like steam turbines.

Reciprocating compressors work on the adiabatic principle (there is no heat transfer between the system and the environment) by which gas is introduced in the compressor cylinder(s) through the inlet valves, is retained and compressed inside the cylinder(s)—typically by a piston arrangement, and is discharged through an outlet. FIG. 1 illustrates a schematic of a typical reciprocating compressor, wherein the gas flow is controlled via a control valve assembly and the compressed outlet gas is delivered to a reservoir for use as needed. These compressors are rarely used as standalone units, except where the process requires intermittent operation.

Reciprocating compressors generate considerable friction between parts like rings and pistons that come in contact with the cylinder walls, the valve springs, and plates or disks that couple with their seats, and between the packing and the connecting rod. All these parts are subject to friction wear, with significant influence on the efficiency of the machine. The motor operation of these compressors is based on either: (1) a connecting rod-crank system; or (2) the gradual pressurization of a fluid activating a piston. There is never a direct, sudden impact applied through reciprocating compressors.

Centrifugal compressors work by applying power from an external source to a shaft that rotates a blade wheel, known as a rotor or impeller, inside a stationary casing, as seen in FIG. 2. When the impeller blades rotate, pressure is reduced at the impeller's inlet, creating suction. The casing may be equipped with a series of outer curved blades that function as a diffuser, whereby the fluid drawn into the inlet is discharged through the outlet at a higher pressure and at a lower flow rate.

A centrifugal compressor offers the following advantages:

- in the 2000 to 200,000 $ft^3$/min capacity range, it is considered an economical compressor
- because a single unit can be utilized over a wide range of compression ratios;
- it offers a considerably wide range of flow with a small load change;
- the relatively low friction between components in the compression flow allows long up-times between maintenance down times, as long as the auxiliary lubrication and seal oil systems are properly sized and functioning;
- large compressed fluid volumes can be obtained in a relatively small location—this can represent a significant advantage where land is costly; and
- it provides a smooth, nonpulsating flow.

Disadvantages of a centrifugal compressor include:

- centrifuges are sensitive to the molecular weight of the gas being compressed;
- unexpected changes in molecular weight can result in a too high or too low discharge pressure;
- very high velocities are required at the impeller ends to produce compression;

a small pressure drop in the system may cause major reductions in the compressor's capacity;

a complex lubricating oil and seal oil system is required.

b. Pumps

Liquid fluid pressure is raised by devices called pumps. The four major fluid pump types are described below:

i. Alternating pumps: These consist of a piston oscillating inside a cylinder equipped with valves to regulate fluid flow to and from the cylinder. These pumps can be single or double-action pumps. In a single-action pump, pumping takes place in only one side of the piston, analogous to a regular impeller pump, and the piston is made to slide up and down the cylinder manually. In a double-action pump, pumping takes place at both sides of the piston, like in electrical or steam boiler feeding pumps used to feed water at high pressure to a water or steam boiler. These pumps may be of one or several stages. Multi-stage alternating pumps have several sequenced cylinders.

ii. Centrifugal pumps: Centrifugal pumps, also called rotating pumps, have a rotating blade rotor or impeller submerged in the fluid. The fluid enters the pump near the rotor axis, and the blades drag it towards their high pressure ends. The rotor also gives the fluid a relatively high velocity that is converted to pressure at the stationary part of the pump, known as the diffuser. In high pressure pumps, several rotors arranged as a series can be used, and diffusers on the back end of each rotor can have guide blades to gradually slow down fluid flow. In low pressure pumps, the diffuser is usual a spiral-shaped channel with a gradually increasing transverse surface to reduce flow speed.

In the case of low flows and high pressures, the rotor action is mainly radial in nature. In higher flows with lower outlet pressures, the sense of flow inside the pump is more parallel to the rotor axis, and thus approximates axial flow. In that case, the rotor acts as a propeller. The transition from one type of condition to another is gradual, and, in intermediate conditions, the nature of the flow is called mixed flow.

iii. Jet pumps: Jet pumps use a high velocity, relatively small fluid or steam flow, to produce a greater flow in another fluid. When the high velocity flow goes through the liquid, it extracts part of the fluid from the pump; while, on the other hand, it creates a vacuum that sucks fluid toward the pump. Jet pumps are often used to inject water into steam boilers. Jet pumps have also been used to propel boats, especially in shallow waters, where a conventional propeller could be damaged.

iv. Other pumps: There are different positive displacement pumps that usually consist of a rotating part, with a series of moving blades inside a tight casing. Fluid is trapped in the spaces between the blades and goes to a higher pressure zone. A common device of this type is the gear pump, consisting of two coupled gearwheels. In this case, the blades are the gearwheel teeth.

A simple, although low efficiency, pump can also be built with a screw rotating inside a casing and propelling fluid. The first to invent a similar pump was the Greek mathematician and physicist, Archimedes, after the year 300 B.C.

In all these pumps, fluid is discharged in a series of pulses and not smoothly, thus, care must be taken to avoid resonance conditions in outlets that could damage or destroy the installation. In alternating pumps, air chambers are frequently included in the outlet to reduce the magnitude of these pulses and permit a smoother flow.

c. The Rankine Cycle

The use of steam as a power generator dates back to the beginning of the $18^{th}$ Century, the time when science made its great contribution to the scientific revolution with the invention of the steam engine. Vaporized water, or steam, has a wide range of uses, among them: movement generation such as in ships, power generation such as in thermal power stations, and washing processes, among others.

All these processes have in common the need to recover steam after it has done its work, in order to have a more efficient and viable process. Here is where the closed power generating cycles are generated.

The basic steps for electric power generation via a steam engine or power plant will now be described. The principle of the process is to evaporate water until steam reaches a certain pressure and temperature. In these conditions, steam is carried though a pipeline to a blade area. Upon steam impacting and heating these blades, they begin to rotate. The blade system is mounted on a shaft or axle for rotation about an axis, and the whole assembly is enclosed in a casing and collectively known as a turbine. The shaft rotation torque is used for generating electric power, or to produce the displacement of some means of transportation or work.

FIG. 3 illustrates a particular steam engine that embodies a modified Rankine Cycle known as a Regenerative Cycle. The components of this system are described as follows:

Boiler: The water evaporation device. It has an area where combustion takes place to generate the heat required for continuous vaporization, under substantially constant pressure, of the desired amount of steam. Steam produced by the boiler is taken through a pipeline to the turbine.

Turbine: As described above, this device consists of a series of blades mounted on a common shaft so that upon being hit by the steam, the shaft to which the blades are attached begins to rotate. The steam expands in the turbine in a substantially adiabatic process.

Condenser: When the steam comes out of the turbine, it is ultimately taken back to the boiler. The turbine discharge steam is initially condensed in the condenser. The condenser is a heat exchanger consisting of two fluid flow sections: one for the circulation of the turbine discharge steam, and another for the circulation of water at room temperature. The exchange of heat between these fluid flow sections causes the steam to return to its liquid water phase.

Pump: The pump has the function of propelling fluid water, and is placed in the cycle after the condenser because a pump is required to move the condensed liquid water.

Pre-Heaters: This is the area where water is preheated before entering the boiler. The Regenerative Cycle of FIG. 3 includes the extraction of a portion of the steam delivered to the turbine for mixing with the condensate from the condenser within the preheater. This is done to increase the temperature of the fluid being delivered to the boiler, whereby efficiency is increased and fuel is saved.

Thus, it is well known that the Rankine cycle, or modifications thereof, is useful to produce power from steam. At present, a steam-liquid water phase change in the condenser is required to close these cycles. The need for such a phase change is the main cause for the low efficiency of these cycles. The Rankine Cycle is useful to generate large amounts of power but its efficiency level is low, and its level of environmental polluting is high.

Besides the Rankine Cycle, it is well known to use a Combined Cycle (Gas Turbine Cycle combined with Steam Turbine Cycle) for power generation. In the Combined Cycle, efficiencies are higher, but such cycles are not very viable for generating large amounts of power, and they are also detrimental to the environment.

It is therefore an object of the present invention to provide a system based on a modified Rankine Cycle that avoids the steam-liquid water phase change, and thereby attains a considerable efficiency increase.

Thermodynamic laws state that energy is neither created nor destroyed, only transformed. Furthermore, no systems are 100% thermally efficient. In other words, all systems actually lose energy. Energy efficiency is measured by the ratio of useful (net) energy to consumed energy which, according to thermodynamic laws, must be less than 1. It is therefore desirable to maximize the ratio of useful energy to consumed energy. This is a further objective of the present invention.

Compressors and pumps manage high pressures but at low flows, or high flows at low pressures. It is a further object of the present invention to provide a system that improves fluid management in a power generation cycle through the use of energy transfer by linear impact, whereby high flowrates can be managed at high pressures.

In internal combustion piston engines, such as in automobiles, an impact is produced at a piston by a shock wage generated by an explosion in a cylinder. In these engines, the movement generated is a linear one, but thereafter there is a decomposition of its power, and a use of energy takes place on a cyclic demand for rotating an output or drive shaft. This assembly does not make optimum use of the energy transferred through the linear force impact, because its final energy use responds to a cyclic demand.

There are known fluid pressure devices that generate linear movements, such as reciprocating stem pumps and compressors, but they use a constant gradual motor fluid system, in particular steam, resulting in a poor use of energy. All lineal piston movements originated by pneumatic or hydraulic means are also accomplished by a gradual inflow of motor fluid. They cannot thus be classified with equipment using impact energy transfer to raise the pressure of the work fluid. To date, it has not been possible to manage (transport and raise pressure) of large fluid flows at high pressures. Referring specifically to gas and steam, there are no compressors designed to transport them at high flows and high pressures.

It is therefore a further object of the present invention to join different principles of operation to create a system allowing the transport of fluids at high pressures for high flowrates. More specifically, the present invention contemplates the use of the impact generated by an instantaneous discharge of a "motor fluid," such as compressed air, at a given pressure to generate a linear movement that is used for managing a "work fluid," for example steam. Once this transmission of energy by linear movement is accomplished, it is used to raise work fluid pressure. By elevating pressure through this system, through a work chamber, fluid (such as gas or steam) pressure increases, and we are able to compress it with more efficiency than any conventional compressor. This increase in fluid pressure, through an elemental chamber, generates a final energy greater that that of all presently available compressors.

In summary, a system is presented for managing large fluid flows at high pressures. This system consists of an elemental chamber the operation of which is based on energy transmission by "impact" resulting from the instantaneous discharge of a motor fluid at a given pressure to generate a linear movement that raises pressure and propels fluid. This system provides an increase in working fluid pressure more efficiently that any presently available system, thanks to the linear transmission of energy, making it highly efficient. The combined arrangement of these chambers allows managing high fluid flows at high pressures.

It is a still further object of the present invention to produce power through a steam cycle without the need for a phase change, eliminating all condensation and preheating stage devices that are replaced by more efficient equipment not requiring the phase change. Thus there is a considerable decrease in the use of fuel, environmental pollution, toxic fumes and thermal pollution, obtaining energy at lower costs.

SUMMARY OF THE INVENTION

The objects described above, as well as various objects and advantages, are achieved by an apparatus including a device for elevating the pressure of a working fluid, and a heater for receiving the working fluid from the pressure-elevating device and elevating the temperature of the working fluid while maintaining the working fluid at a substantially constant pressure within the heater. A turbine receives the working fluid from the heater and converts the energy of the working fluid into torque at an output shaft of the turbine. Means are also provided for delivering substantially all of the working fluid from the turbine to the pressure-elevating device to complete a power generation cycle.

The pressure elevating device, or compressor, preferably includes a first cylindrical pressure vessel and a first piston dividing the first pressure vessel into first and second chambers. An actuator is provided for reciprocating the first piston through forward and reverse strokes. A first valve system selectively controls the delivery of the working fluid to the first and second chambers such that the forward piston stroke draws working fluid under reduced pressure into the second chamber while discharging working fluid at elevated pressure from the first chamber, and the reverse piston stroke draws working fluid under reduced pressure into the first chamber while discharging working fluid at elevated pressure from the second chamber.

It is preferred that the first valve system includes an intake and exhaust valve controlling the working fluid flow through each of the first and second chambers of the first pressure vessel.

The actuator of the pressure elevating device preferably includes a second cylindrical pressure vessel and a second piston dividing the second pressure vessel into first and second chambers. An impact system is provided for reciprocating the second piston through forward and reverse strokes. A second valve system selectively controls the delivery of pressure-elevated fluid, such as air, to the first and second chambers of the second pressure vessel such that injection of pressure-elevated fluid into the second chamber urges movement of the second piston through a forward piston stroke at which time the fluid in the first chamber is discharged, and the injection of pressure-elevated fluid into the first chamber urges movement of the second piston through a reverse piston stroke at which time fluid in the second chamber is discharged. A rod extends between the first and second pressure vessels through respective first and second seal assemblies, and is connected to the second piston at one end thereof and the first piston at the other end thereof. Thus, movement of the second piston through its forward and reverse strokes actuates movement of the first piston, via the rod, through the first piston's forward and reverse strokes, respectively.

The impact system preferably includes a fluid compressor, such as an air compressor when the fluid is air, and a network of fluid lines rated for elevated pressures. It is further preferred that the second valve system includes an intake and exhaust valve controlling the fluid flow through each of the first and second chambers.

In another aspect, the present invention contemplates a steam compressor, including a first cylindrical pressure vessel and a first piston dividing the first pressure vessel into first and second chambers. An actuator is provided for reciprocating the first piston through forward and reverse strokes. A first valve system selectively controls the delivery of steam to the first and second chambers such that the forward piston stroke draws steam under reduced pressure into the second chamber while discharging steam at elevated pressure from the first chamber, and the reverse piston stroke draws steam under reduced pressure into the first chamber while discharging steam at elevated pressure from the second chamber. The actuator includes a second cylindrical pressure vessel and a second piston dividing the second pressure vessel into first and second chambers. An impact system is provided for reciprocating the second piston via pressure-elevated fluid, such as compressed air, through forward and reverse strokes. A second valve system selectively controls the delivery of pressure-elevated fluid to the first and second chambers of the second pressure vessel such that injection of pressure-elevated fluid into the second chamber urges movement of the second piston through a forward piston stroke at which time the fluid in the first chamber is discharged, and the injection of pressure-elevated fluid into the first chamber urges movement of the second piston through a reverse piston stroke at which time the fluid in the second chamber is discharged. A rod extends between the first and second pressure vessels through respective first and second seal assemblies, the rod being connected to the second piston at one end thereof and being connected to the first piston at the other end thereof, whereby movement of the second piston through its forward and reverse strokes actuates movement of the second piston through its forward and reverse strokes, respectively.

In yet another aspect, the present invention contemplates a method for generating power, including the step of elevating the pressure of steam using a compressor. The steam from the compressor is then delivered to a heater, and the temperature of the steam is elevated using the heater while maintaining the steam at a substantially constant pressure within the heater. The steam is then delivered from the heater to a turbine, which converts the energy of the steam within the turbine into torque at an output shaft of the turbine. Next, substantially all of the steam from the turbine is delivered to the compressor to complete a power generation cycle.

In a particular embodiment of the present invention, the working fluid is water and the pressure-elevating device is a compressor. More particularly, it is preferred that the water be maintained in a vapor phase, or steam, throughout the power generation cycle once steady-state operation is achieved.

The present invention may also be used to advantage as a power plant by adding a generator for converting the torque of the output shaft of the turbine into electricity.

BRIEF DESCRIPTION OF THE DRAWING(S)

A more particular description of the invention, briefly summarized above, may be had by reference to the preferred embodiment thereof which is illustrated in the appended drawings.

It is to be noted however, that the appended drawings illustrate only a typical embodiment of this invention and are therefore not to be considered limiting of its scope, for the invention may admit to other equally effective embodiments.

DESCRIPTION OF THE PREFERRED EMBODIMENT(S)

Figure 1:
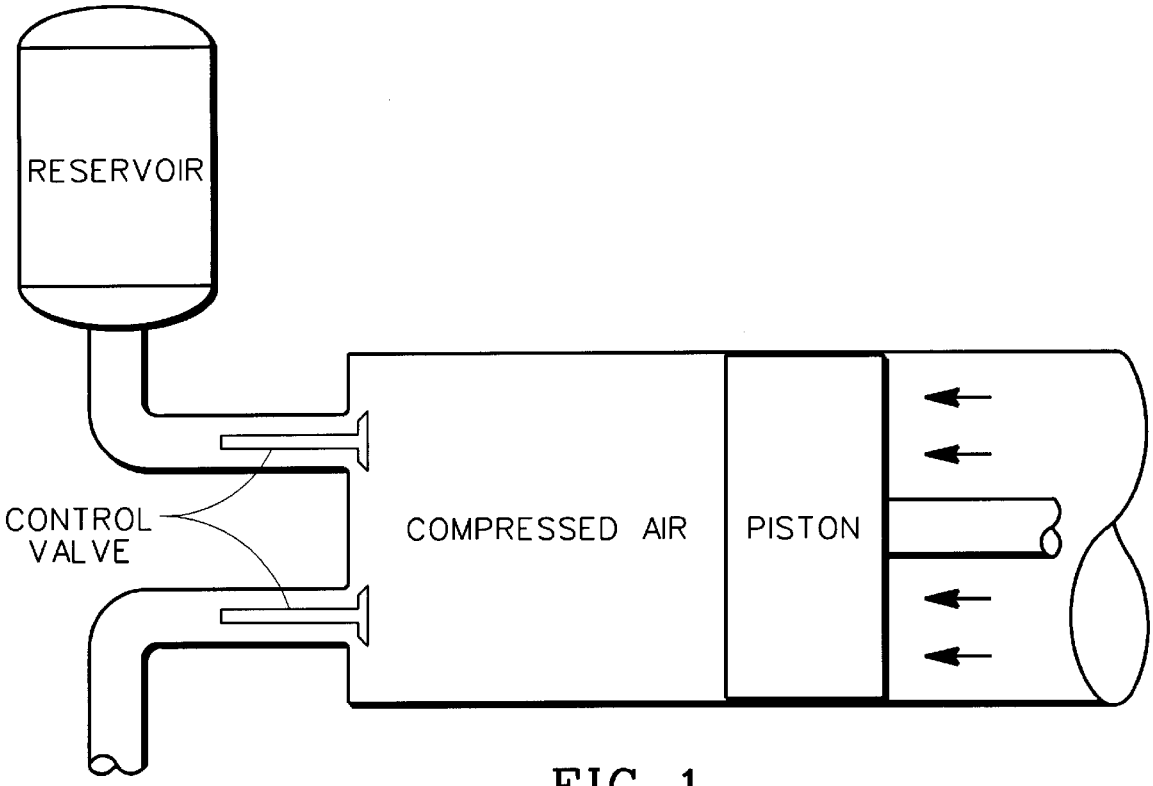
FIG. 1 (PRIOR ART)
FIG. 1 is a schematic representation of a reciprocating compressor assembly.
Figure 2:
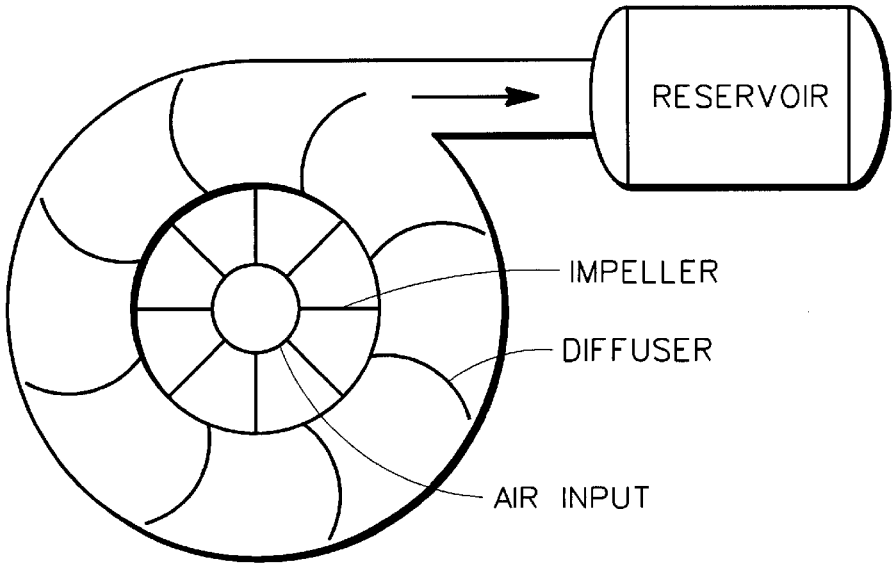
FIG. 2 (PRIOR ART)
FIG. 2 is a schematic representation of a centrifugal compressor assembly.
Figure 3:
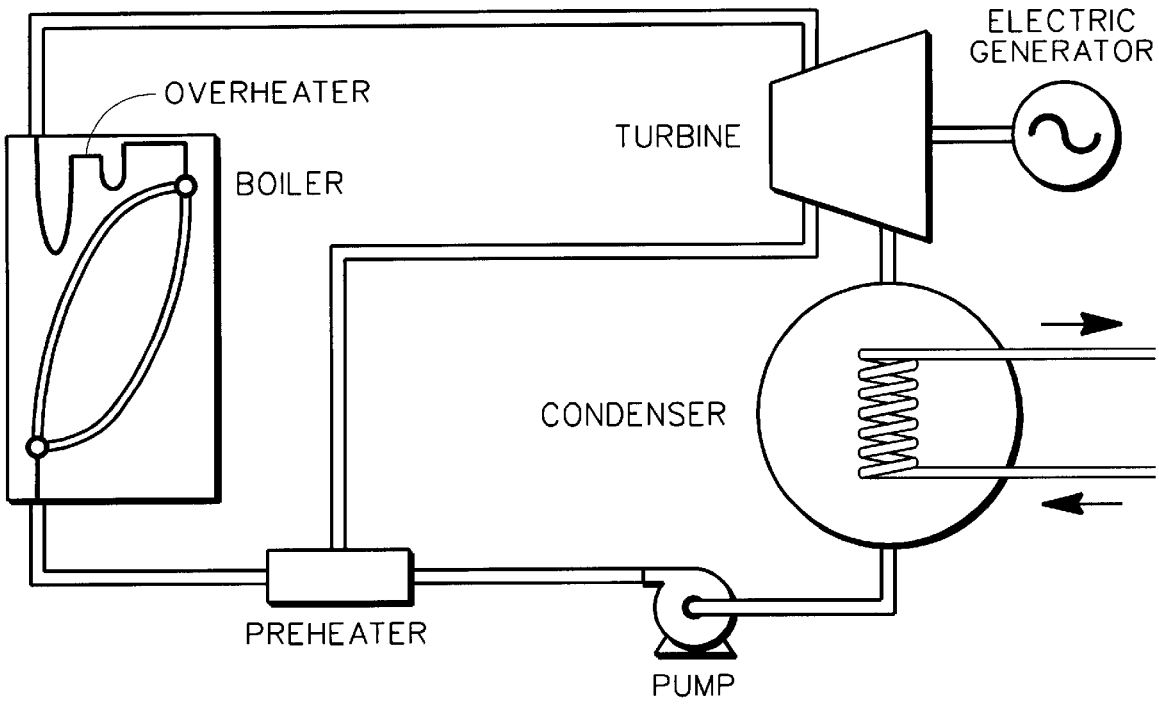
FIG. 3 (PRIOR ART)
FIG. 3 is a schematic representation of a steam power plant utilizing a modified Rankine Cycle called a Regenerative Cycle.
Figure 4:
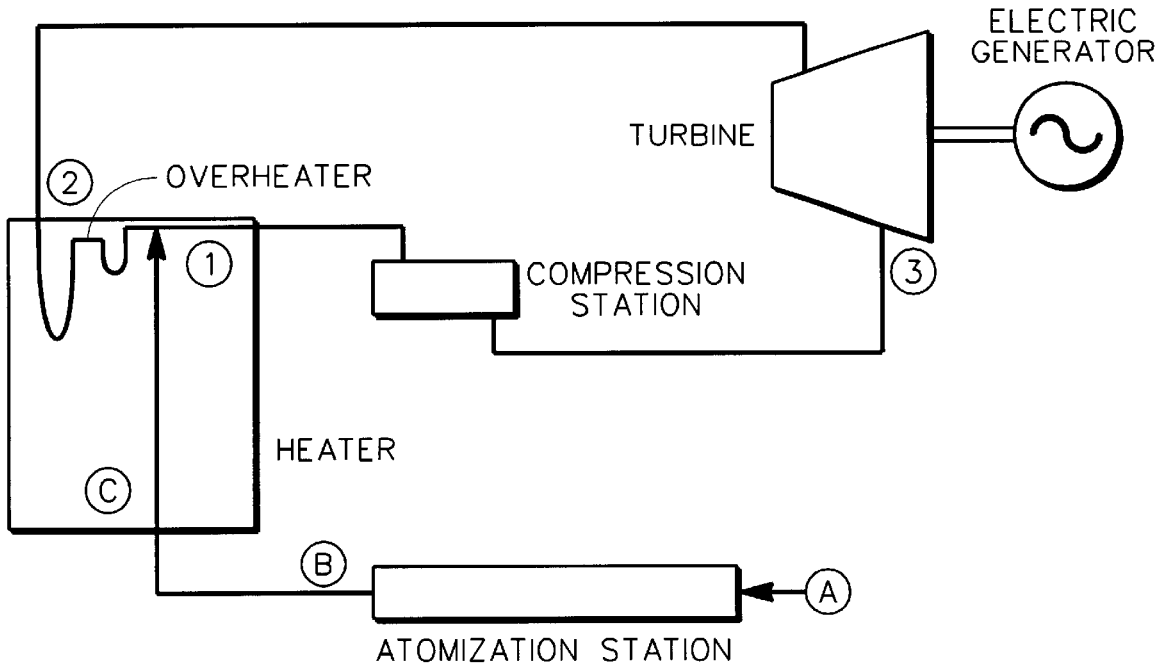
FIG. 4 is a schematic representation of a steam power plant according to the present invention.
Figure 5:
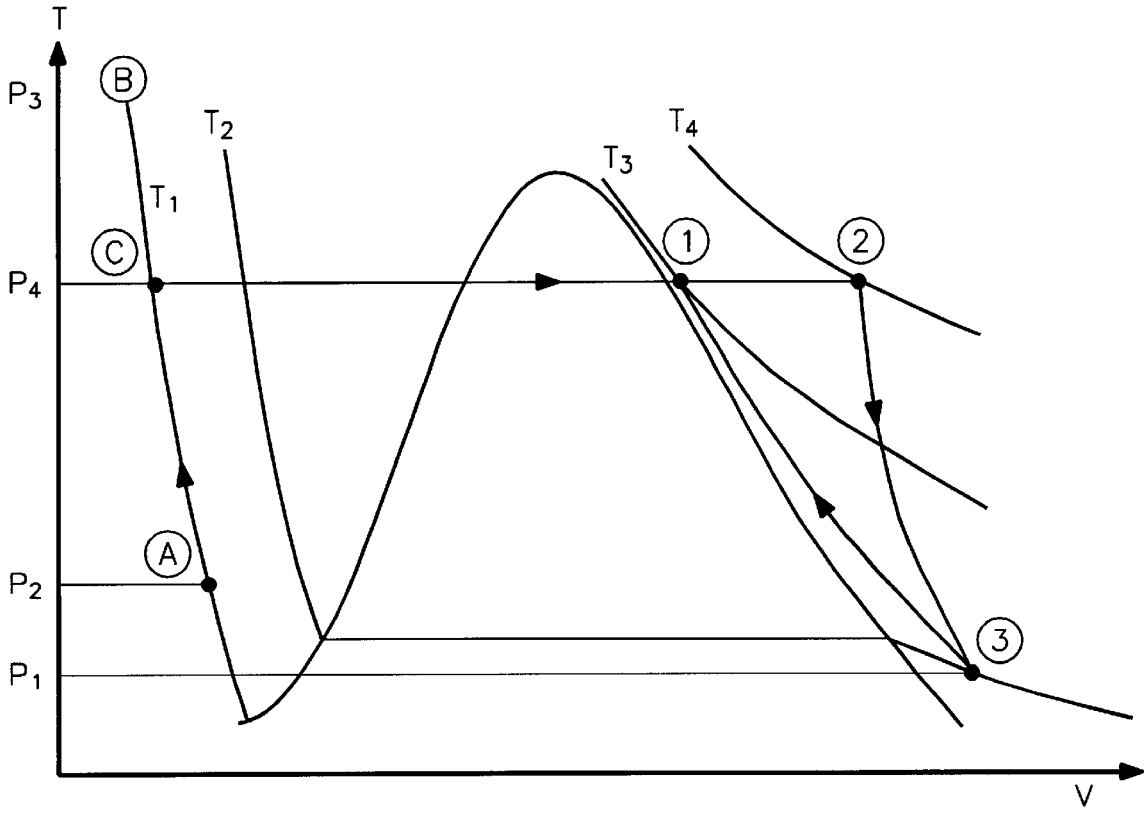
FIG. 5 is a plot of pressure versus volume for the steam power plant of FIG. 4.

FIGS. 4 and 5 illustrates a power generation cycle, more particularly a steam power plant schematic and a pressure-versus-volume plot, respectively, according to a preferred embodiment of the present invention. The power generation cycle may be broken down into two processes; a first process characterized by reference points A-B-C-1, and second process characterized by reference points 1-2-3.

A-B-C-1 Process

The working fluid, in the form of feedwater, is introduced to the system at reference point A having a pressure P2 and a temperature T1. The feedwater is initially compressed in an atomizing station (seen in FIG. 4) under adiabatic conditions, resulting in a pressure P3 at temperature T1, as indicated at point B in FIG. 5. The water at condition B is then injected from the atomizing station into a heater, resulting in a slight expansion of the water at constant temperature to achieve pressure P4 and temperature T1, as indicated at reference point C in FIG. 5.

The heater receives the working fluid water from the atomizing station, and elevates the temperature of the water to temperature T3 while maintaining the water at a substantially constant pressure P4 within the heater, as indicated at reference point 1 in FIGS. 4 and 5. It should be noted that at start up, feedwater will initiate the power generation cycle, while in steady-state operation, substantially only the recycled steam will be needed for injection into the heater. Thus, the atomization station is only needed minimally during steady-state operation.

1-2-3 Process

The second process is initiated at reference point 1, with the injection of the steam at pressure P4 and temperature T3 into a boiler overheater. The overheater brings the steam up to the required working temperature T4 while maintaining the pressure substantially constant at P4. This condition corresponds to point 2 in FIGS. 4 and 5. A turbine receives the working fluid from the overheater and converts the energy of the working fluid into torque at an output shaft of the turbine. Through this energy conversion process, the steam rejects a portion of its heat to the turbine blades and undergoes expansion in the turbine. The steam is discharged from the turbine at conditions P1 (substantially reduced pressure from P4) and T2 (substantially reduced temperature from T4), and remains substantially in vapor phase. This condition is referenced at point 3 in FIGS. 4 and 5.

Compression is provided in a compression station for substantially elevating the pressure of the steam. The steam compression process elevates the pressure from P1 back up to P4, and also elevates the temperature of the steam from T2 to T3, whereby the steam is at reference point 1 in FIGS. 4 and 5, above saturation. This is the condition at which the steam is delivered to the heater during steady-state operation, as seen in FIG. 4. Substantially all of the steam discharged from the turbine is thus delivered to the heater via means including insulated, high-pressure steam lines and fittings.

Those skilled in the art will appreciate that the present invention may clearly be used to advantage as a power plant by utilizing a generator, as indicated in FIG. 4, for converting the torque of the output shaft of the turbine into electricity. The use of such generators is well known, and will not be described further herein.

Compression Station

An important aspect of the present invention, according to a preferred embodiment, resides in the pressure elevating device, or compressor, that is disposed between the turbine and the heater in the power generation plant. As stated previously, it is desirable for the compressor to deliver an "impact" to the steam working fluid resulting from the instantaneous discharge of a "motor fluid" at a given pressure to generate a "linear" movement that raises the pressure of and propels the working fluid. This system provides an increase in working fluid pressure more efficiently that any presently available system, thanks to the linear transmission of energy, making it highly efficient.

Figure 6:
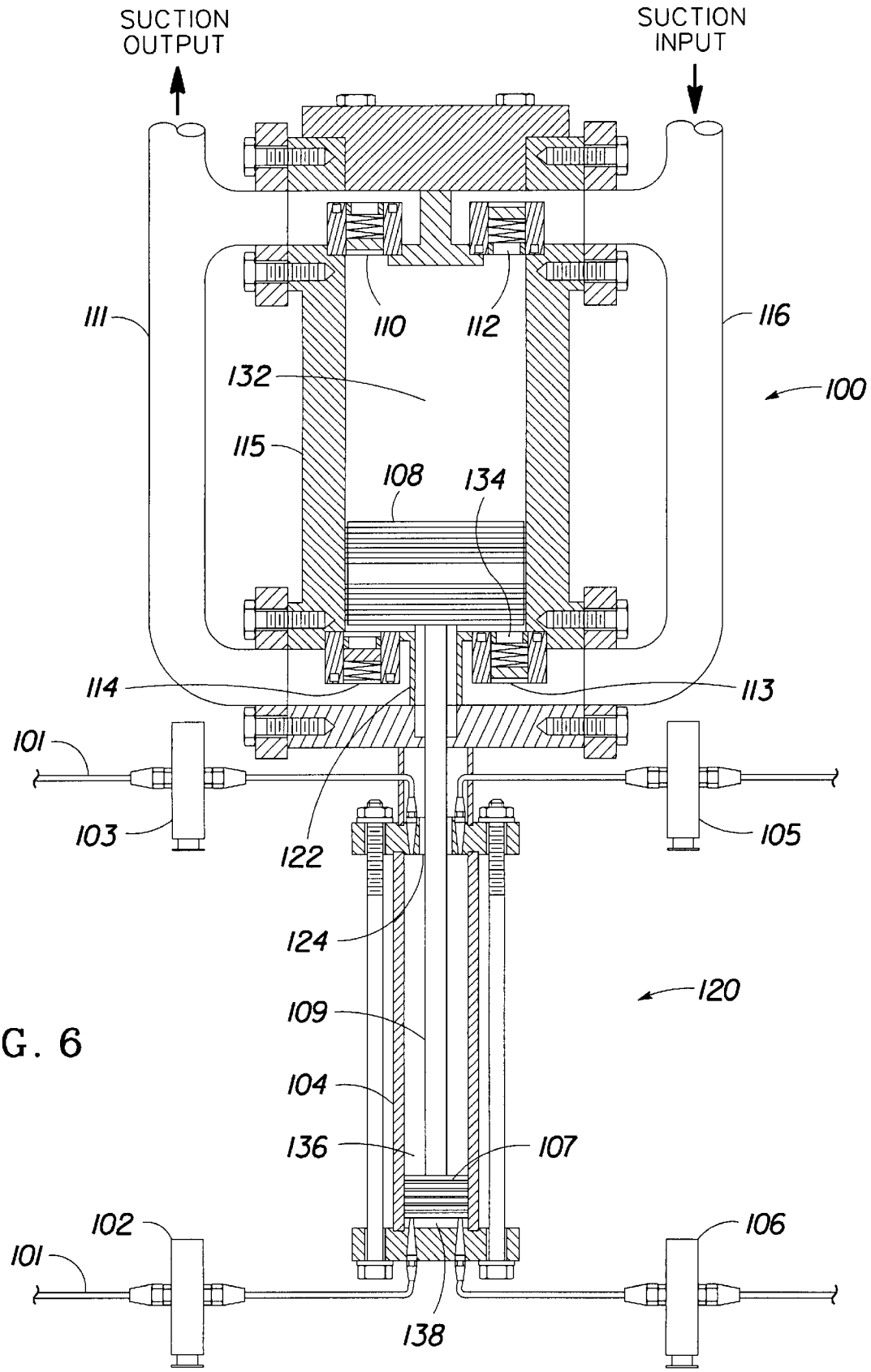
FIG. 6 is an elevational view, taken in section, of a compressor in accordance with the present invention.

FIG. 6 illustrates compressor unit 100 in accordance with a preferred embodiment of the present invention. Compressor unit 100 includes a first cylindrical pressure vessel 115 and a first piston 108 dividing the first pressure vessel into first and second chambers 132 and 134, respectively. An actuator system (discussed further below) is provided for reciprocating the first piston 108 through forward and reverse strokes.

A first valve system selectively controls the delivery of the steam working fluid from the turbine to the first and second chambers of pressure vessel 115. The forward stroke of first piston 108 under pushing force from rod 109 draws steam under input pressure into second chamber 134 while discharging steam at elevated output pressure from first chamber 132. The steam in first chamber 132 is first compressed to an extent that it overcomes the spring force of forward discharge valve 110 to open valve 110 and discharge the pressure-elevated steam to discharge manifold 111. This same increase in steam pressure in the first chamber keeps the back inlet valve 112 closed, since its spring is reversed from that of valve 110 as shown in FIG. 6.

The forward movement of the first piston 108 also creates a vacuum in second chamber 134 of pressure vessel 115 that causes the opening of the forward inlet valve 113 by overcoming the pressure of the closing spring on valve 113. This action draws steam into the second chamber from the turbine via suction manifold 116. Back outlet valve 114 is preventing from opening at this time because the suction works with the closing spring on valve 114, preventing steam backflow from the first stage discharge manifold 111 into the second chamber.

Similarly, the reverse stroke of first piston 108 under pulling force from rod 109 draws steam under input pressure into first chamber 132 while discharging steam at output pressure from second chamber 134. The counter movement of the first piston 108 increases the pressure of the steam sucked into the second chamber during the previous forward stroke of fist piston 108. This increase in steam work fluid pressure in the second chamber of pressure vessel 115 causes the back discharge valve 114 to open when the steam pressure overcomes the force of the closing spring attached to valve 114, at which time the pressure-elevated steam is discharged via first stage discharge manifold 111 to the heater. This same increase in steam pressure in the second chamber keeps the forward inlet valve 113 closed, since the pressure works with the closing spring attached to valve 113.

The reverse stroke of first piston 108 also creates a vacuum in first chamber 132 of pressure vessel 115 that forces the back inlet valve 112 to open, allowing the entry of steam into the first chamber from the suction manifold 116. Simultaneously, the vacuum in the first chamber prevents the forward outlet valve 113 from opening, preventing the feedback of the process fluid from the first stage discharge manifold 111 into the first chamber.

The actuator 120 for the compressor unit 100 preferably includes a second cylindrical pressure vessel 104 and a second piston 107 dividing the second pressure vessel into first and second chambers 136 and 138, respectively. An impact system, preferably including a fluid compressor, more particularly an air compressor in one preferred embodiment, and a network of fluid lines, for example, air lines, rated for elevated pressures, is provided for reciprocating the second piston through forward and reverse strokes. The impact system is key to the compressor operation, for it provides the sudden, linear impact which achieves the high efficiency possible with the preferred embodiment of the present invention.

A second valve system selectively controls the delivery of pressure-elevated fluid, such as compressed air, to the first and second chambers of the second pressure vessel 104 such that injection of pressure-elevated fluid into second chamber 138 urges movement of the second piston 107 through a forward piston stroke at which time fluid in first chamber 136 is discharged. The injection of pressure-elevated fluid into first chamber 136 urges movement of the second piston 107 through a reverse piston stroke at which time fluid in second chamber 138 is discharged. A rod 109 extends between the first pressure vessel 115 and second pressure vessel 104 through respective first and second seal assemblies 122, 124. Rod 109 is connected to the second piston 107 at one end of the rod, and connected to the first piston 108 at the other end thereof Thus, movement of the second piston 107 through its forward and reverse strokes actuates movement of the first piston 108, via the rod 109, through the first piston's forward and reverse strokes, respectively.

The operation of actuator system 120 further includes a high pressure fluid line 101, an injection valve system 102 and 103 allowing the immediate injection of the fluid into the respective chambers of pressure vessel 104, and an exhaust valve system 105 and 106 preventing counter-pressure in the respective opposing chambers of pressure vessel 104. The impact produced by this instantaneous fluid injection into the chambers acts on the second piston 107, generating a linear movement that is then transmitted to the first piston 108 by rod 109 causing the desired increase in the steam work fluid pressure.

Operation of the Actuator

The actuator system is designed so that valves 102 and 105 open simultaneously while valves 103 and 106 are closed. When the forward impact control valve 102 opens momentarily, an instantaneous fluid impact force is delivered through second chamber 138 of pressure vessel 104 to the second piston 107, resulting in the forward displacement of this piston. Since the forward exhaust control valve 105 opens simultaneously valve 102, the fluid contained in first chamber 136 in front of the second piston 107 is exhausted, avoiding counter-pressure on piston 107.

To complete the cycle, valves 103 and 106 open simultaneously while valves 102 and 105 close. When the back impact control valve 103 opens momentarily, an instantaneous fluid impact force is delivered through first chamber 136 of pressure vessel 104 to the second piston 107, resulting in the backward displacement of this piston. Since the back exhaust control valve 106 exhausts the fluid contained in second chamber 138 behind the second piston 107, counter-pressure on piston 107 is again avoided.

Figure 7:
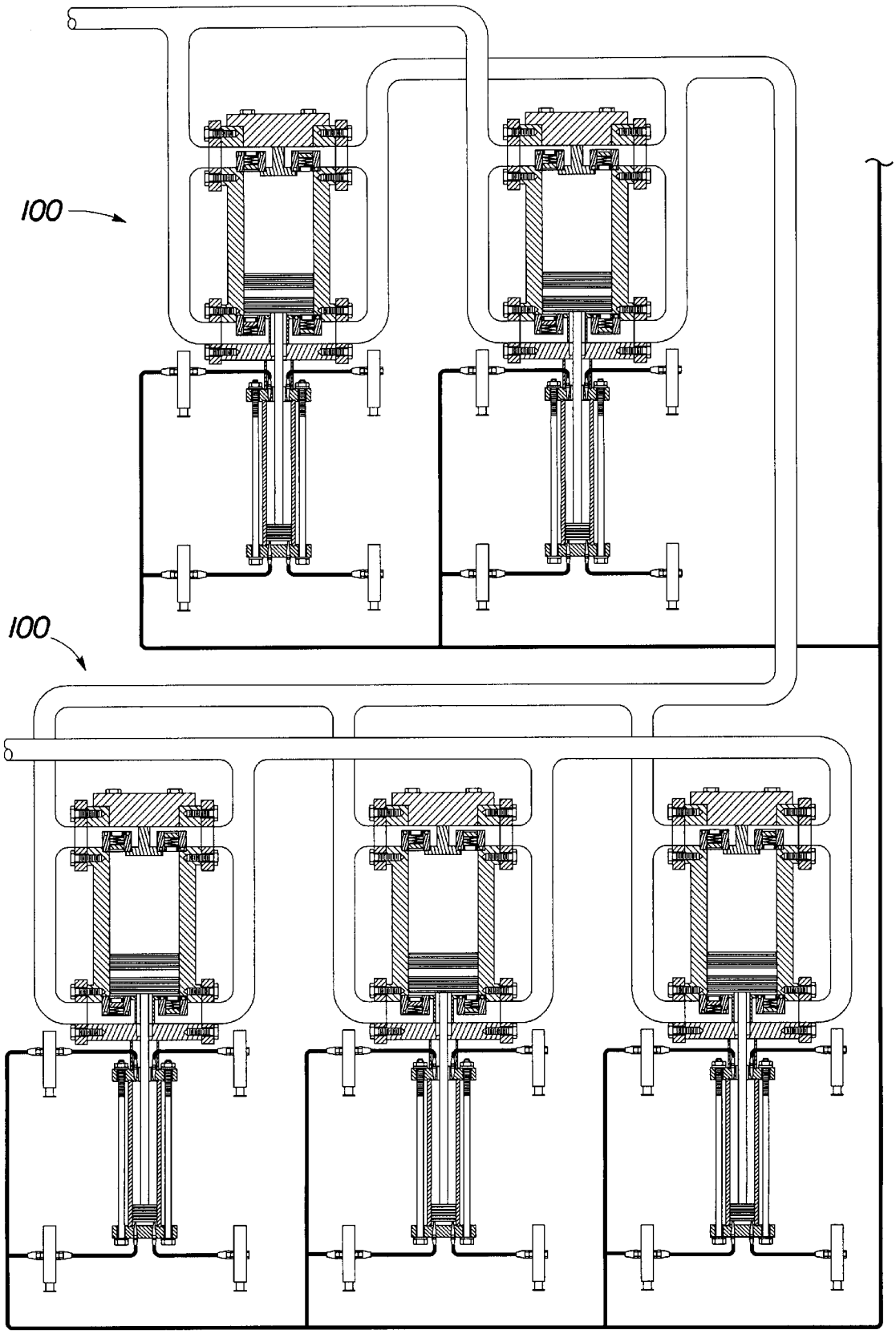
FIG. 7 illustrates a custom network of compressors such as that shown in FIG. 6 for achieving the system power and efficiency demands.

FIG. 7 illustrates that the compression station of FIG. 4 may include several compressor units 100 fluidly communicating in parallel and/or in series as desirable to deliver the required power and maximize the efficiency of the overall system.

Those skilled in the art and given the benefit of this disclosure will appreciate that the power generation system of the present invention need not require equipment for conducting the vapor-liquid phase change of known steam engines or power plants. Since the steam-liquid water phase exchange will be avoided, high-pressure steam can be delivered at high capacities. This results in a considerable increase in the efficiency of utilities using this method.

Other advantages may be expressed as follows:

Qualitative factors:

Lower use of nonrenewable resources (fuel);

Decrease in toxic emissions to the environment;

Non-use of a major hydraulic source for the operation of the power station, making it highly eco-efficient; and Simplification and optimization of the production process.

Quantitative factors:

Decrease in operation costs; and

Decrease in costs of Kilowatt/Hour produced.

In view of the foregoing it is evident that the present invention is well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive. The scope of the invention is indicated by the claims that follow rather than the foregoing description, and all changes which come within the meaning and range of equivalence of the claims are therefore intended to be embraced therein.

For example, the working fluid has been primarily described as water, but other pure, uncontaminated fluids such as well-known refrigerants may be used as a working fluid to similar advantage.

What is claimed is:

1. An apparatus for generating power, comprising:

a device for elevating the pressure of a working fluid;

a heater for receiving the working fluid from the pressure-elevating device and elevating the temperature of the working fluid while maintaining the working fluid at a substantially constant pressure within the heater;

a turbine for receiving the working fluid from the heater and converting the energy of the working fluid into torque at an output shaft of the turbine; and means for delivering substantially all of the working fluid from the turbine to the pressure-elevating device to complete a power generation cycle;

wherein the pressure elevating device comprises a first cylindrical pressure vessel, a first piston dividing the first pressure vessel into first and second chambers, an actuator for reciprocating the first piston through forward and reverse strokes, and a first valve system for selectively controlling the delivery of the working fluid to the first and second chambers such that the forward piston stroke draws working fluid under reduced pressure into the second chamber while discharging working fluid at elevated pressure from the first chamber, and the reverse piston stroke draws working fluid under reduced pressure into the first chamber while discharging working fluid at elevated pressure from the second chamber.

2. The apparatus claim 1, wherein the working fluid is a pure fluid.

3. The apparatus of claim 1, further comprising a generator for converting the torque of the output shaft of said turbine into electricity.

4. The apparatus of claim 1, wherein said actuator includes a second cylindrical pressure vessel, a second piston dividing the second pressure vessel into first and second chambers, an impact system for reciprocating the second piston through forward and reverse strokes, a second valve system for selectively controlling the delivery of pressure-elevated fluid to the first and second chambers of the second pressure vessel such that injection of pressure-elevated fluid into the second chamber urges movement of the second piston through a forward piston stroke at which time fluid in the first chamber is discharged, and the injection of pressure-elevated fluid into the first chamber urges movement of the second piston through a reverse piston stroke at which time fluid in the second chamber is discharged, and a rod extending between the first and second pressure vessels through respective first and second seal assemblies, the rod being connected to the second piston at one end thereof and being connected to the first piston at the other end thereof, whereby movement of the second piston through its forward and reverse strokes actuates movement of the first piston through its forward and reverse strokes, respectively.

5. The apparatus of claim 4, wherein the impact system includes a fluid compressor and a network of fluid lines rated for elevated pressures.

6. The apparatus of claim 4, wherein the second valve system includes an intake and exhaust valve controlling the fluid flow through each of the first and second chambers.

7. The apparatus of claim 1, wherein the first valve system includes an intake and exhaust valve controlling the working fluid flow through each of the first and second chambers of the first pressure vessel.

8. The apparatus of claim 4, wherein the fluid is air.

9. An apparatus for generating power, comprising:

a compressor comprising:

a first cylindrical pressure vessel, a first piston dividing the first pressure vessel into first and second chambers, an actuator for reciprocating the piston through forward and reverse strokes, and a first valve system for selectively controlling the delivery of steam to the first and second chambers such that the forward piston stroke draws steam under reduced pressure into the second chamber while discharging steam at elevated pressure from the first chamber, and the reverse piston stroke draws steam under reduced pressure into the first chamber while discharging steam at elevated pressure from the second chamber;

a heater for receiving the steam from said compressor and elevating the temperature of the steam while maintaining the steam at a substantially constant pressure within said heater;

a turbine for receiving the steam from said heater and converting the energy of the steam into torque at an output shaft of said turbine; and means for delivering substantially all of the steam from said turbine to said compressor to complete a power generation cycle.

10. The apparatus of claim 9, wherein the actuator includes a second cylindrical pressure vessel, a second piston dividing the second pressure vessel into first and second chambers, an impact system for reciprocating the second piston via pressure-elevated fluid through forward and reverse strokes, a second valve system for selectively controlling the delivery of pressure-elevated fluid to the first and second chambers of the second pressure vessel such that injection of pressure-elevated fluid into the second chamber urges movement of the second piston through a forward piston stroke at which time fluid in the first chamber is discharged, and the injection of pressure-elevated fluid into the first chamber urges movement of the second piston through a reverse piston stroke at which time fluid in the second chamber is discharged, and a rod extending between the first and second pressure vessels through respective first and second seal assemblies, the rod being connected to the second piston at one end thereof and being connected to the first piston at the other end thereof, whereby movement of the second piston through its forward and reverse strokes actuates movement of the second piston through its forward and reverse strokes, respectively.

11. The apparatus of claim 10, wherein the impact system includes a fluid compressor and a network of fluid lines rated for elevated pressures.

12. The apparatus of claim 10, wherein the second valve system includes an intake and exhaust valve controlling the fluid flow through each of the first and second chambers.

13. The apparatus of claim 9, wherein the first valve system includes an intake and exhaust valve controlling the working fluid flow through each of the first and second chambers of the first pressure vessel.

14. A steam compressor, comprising:

a first cylindrical pressure vessel;

a first piston dividing the first pressure vessel into first and second chambers;

an actuator for reciprocating the piston through forward and reverse strokes;

a first valve system for selectively controlling the delivery of steam to the first and second chambers such that the forward piston stroke draws steam under reduced pressure into the second chamber while discharging steam at elevated pressure from the first chamber, and the reverse piston stroke draws steam under reduced pressure into the first chamber while discharging steam at elevated pressure from the second chamber;

said actuator including a second cylindrical pressure vessel, a second piston dividing the second pressure vessel into first and second chambers, an impact sysytem for reciprocating the second piston via pressure-elevated fluid through forward and reverse strokes, a second valve system for selectively controlling the delivery of pressure-elevated fluid to the first and second chambers of the second pressure vessel such that injection of pressure-elevated fluid into the second chamber urges movement of the second piston through a forward piston stroke at which time fluid in the first chamber is discharged, and the injection of pressure-elevated fluid into the first chamber urges movement of the second piston through a reverse piston stroke at which time fluid in the second chamber is discharged, and a rod extending between the first and second pressure vessels through respective first and second seal assemblies, the rod being connected to the second piston at one end thereof and being connected to the first piston at the other end thereof, whereby movement of the second piston through its forward and reverse strokes actuates movement of the second piston through its forward and reverse strokes, respectively.

15. The steam compressor of claim 14, wherein the impact system includes a fluid compressor and a network of fluid lines rated for elevated pressures.

16. The steam compressor of claim 14, wherein the second valve system includes an intake and exhaust valve controlling the fluid flow through each of the first and second chambers.

17. The steam compressor of claim 14, wherein the first valve system includes an intake and exhaust valve controlling the working fluid flow through each of the first and second chambers of the first pressure vessel.

18. The steam compressor of claim 14, wherein the fluid is air.

19. A method for generating power, comprising the steps of:

elevating the pressure of steam using a compressor;

delivering the steam from the compressor to a heater;

elevating the temperature of the steam using the heater while maintaining the steam at a substantially constant pressure within the heater;

delivering the steam from the heater to a turbine;

converting the energy of the steam within the turbine into torque at an output shaft of the turbine; and delivering substantially all of the steam from the turbine to the compressor to complete a power generation cycle.

20. The method of claim 19, wherein the compressor comprises a first cylindrical pressure vessel, a first piston dividing the first pressure vessel into first and second chambers, an actuator for reciprocating the piston through forward and reverse strokes, and a first valve system for selectively controlling the delivery of steam to the first and second chambers such that the forward piston stroke draws steam under reduced pressure into the second chamber while discharging steam at elevated pressure from the first chamber, and the reverse piston stroke draws steam under reduced pressure into the first chamber while discharging steam at elevated pressure from the second chamber.

21. The method of claim 20, wherein the actuator includes a second cylindrical pressure vessel, a second piston dividing the second pressure vessel into first and second chambers, an impact system for reciprocating the second piston via pressure-elevated fluid through forward and reverse strokes, a second valve system for selectively controlling the delivery of pressure-elevated fluid to the first and second chambers of the second pressure vessel such that injection of pressure-elevated fluid into the second chamber urges movement of the second piston through a forward piston stroke at which time fluid in the first chamber is discharged, and the injection of pressure-elevated fluid into the first chamber urges movement of the second piston through a reverse piston stroke at which time fluid in the second chamber is discharged, and a rod extending between the first and second pressure vessels through respective first and second seal assemblies, the rod being connected to the second piston at one end thereof and being connected to the first piston at the other end thereof, whereby movement of the second piston through its forward and reverse strokes actuates movement of the second piston through its forward and reverse strokes, respectively.

22. A fluid pressure-elevating device comprising:

a first cylindrical pressure vessel;

a first piston dividing the first pressure vessel into first and second chambers;

an actuator for reciprocating the piston through forward and reverse strokes;

a first valve system for selectively controlling the delivery of working fluid to the first and second chambers such that the forward piston stroke draws working fluid under reduced pressure into the second chamber while discharging working fluid at elevated pressure from the first chamber, and the reverse piston stroke draws working fluid under reduced pressure into the first chamber while discharging working fluid at elevated pressure from the second chamber;

said actuator including a second cylindrical pressure vessel, a second piston dividing the second pressure vessel into first and second chambers, an impact sysytem for reciprocating the second piston via pressure-elevated fluid through forward and reverse strokes, a second valve system for selectively controlling the delivery of pressure-elevated fluid to the first and second chambers of the second pressure vessel such that injection of pressure-elevated fluid into the second chamber urges movement of the second piston through a forward piston stroke at which time fluid in the first chamber is discharged, and the injection of pressure-elevated fluid into the first chamber urges movement of the second piston through a reverse piston stroke at which time fluid in the second chamber is discharged, and a rod extending between the first and second pressure vessels through respective first and second seal assemblies, the rod being connected to the second piston at one end thereof and being connected to the first piston at the other end thereof, whereby movement of the second piston through its forward and reverse strokes actuates movement of the second piston through its forward and reverse strokes, respectively.

23. The device of claim 22, further comprising at least one additional such device fluidly communicating in parallel and or in series therewith to make up a compression station as desirable to deliver desired power and efficiency requirements.

* * * * *